US010593270B2

(12) United States Patent
Lee et al.

(10) Patent No.: US 10,593,270 B2
(45) Date of Patent: Mar. 17, 2020

(54) ORGANIC LIGHT EMITTING DISPLAY DEVICE AND DRIVING METHOD THEREOF

(71) Applicant: LG DISPLAY CO., LTD., Seoul (KR)

(72) Inventors: DongYoun Lee, Gwangju (KR); SockJong Yoo, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 140 days.

(21) Appl. No.: 15/845,949

(22) Filed: Dec. 18, 2017

(65) Prior Publication Data

US 2019/0066603 A1 Feb. 28, 2019

(30) Foreign Application Priority Data

Aug. 31, 2017 (KR) ..... 10-2017-0111243

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0426* (2013.01); *G09G 2300/0861* (2013.01); *G09G 2310/08* (2013.01); *G09G 2320/0295* (2013.01); *G09G 2320/0693* (2013.01)

(58) Field of Classification Search
CPC ..... G09G 3/3291; G09G 3/3233
USPC ..... 345/212, 215; 1/1
See application file for complete search history.

(56) References Cited

U.S. PATENT DOCUMENTS

2015/0294626 A1* 10/2015 Bi ..... G09G 3/3233 345/211
2016/0203764 A1* 7/2016 In ..... G09G 3/3225 345/215
2017/0069238 A1* 3/2017 Moon ..... G09G 3/006
2017/0154603 A1* 6/2017 Gu ..... G09G 3/2003
2018/0122334 A1* 5/2018 Coppin ..... G09G 3/2096
2018/0174517 A1* 6/2018 Lee ..... G09G 3/3233
2018/0218678 A1* 8/2018 Kwon ..... G09G 3/2018
2018/0277037 A1* 9/2018 Lin ..... G06F 3/0412
2018/0357958 A1* 12/2018 Kwon ..... G09G 3/3233

* cited by examiner

*Primary Examiner* — Prabodh M Dharia
(74) *Attorney, Agent, or Firm* — Seed Intellectual Property Law Group LLP

(57) ABSTRACT

An organic light emitting display device includes a display panel including a plurality of data lines, a plurality of scan lines, and a plurality of pixels respectively provided in a plurality of areas defined by intersections of the plurality of data lines and the plurality of scan lines, a display panel driver configured to apply data voltages to the plurality of data lines and apply scan signals to the plurality of scan lines, a timing controller configured to control an operation timing of the display panel driver, and a control circuit board including the timing controller a volatile memory. If a first main voltage is applied to the volatile memory when the organic light emitting display device is turned off.

14 Claims, 7 Drawing Sheets

ORGANIC LIGHT EMITTING DISPLAY DEVICE AND DRIVING METHOD THEREOF

CROSS-REFERENCE TO RELATED APPLICATIONS

This application claims the benefit of the Korean Patent Application No. 10-2017-0111243 filed on Aug. 31, 2017, which is hereby incorporated by reference as if fully set forth herein.

BACKGROUND

Technical Field

The present disclosure relates to an organic light emitting display device and a driving method thereof.

Description of the Related Art

With the advancement of information-oriented society, various requirements for display devices for displaying an image are increasing. Therefore, various display devices such as liquid crystal display (LCD) devices, plasma display panel (PDP) devices, organic light emitting display devices, and quantum dot display (QD) devices are being used recently. In such display devices, the organic light emitting display devices are driven with a low voltage and have a thin thickness, a good viewing angle, and a fast response time.

The organic light emitting display devices include a display panel which includes a plurality of data lines, a plurality of scan lines, and a plurality of pixels respectively provided in a plurality of pixel areas defined by intersections of the data lines and the gate lines, a scan driver which supplies scan signals to the scan lines, and a data driver which supplies data voltages to the data lines.

Each of the pixels includes an organic light emitting device, a driving transistor which controls the amount of current supplied to the organic light emitting device with a voltage of a gate electrode thereof, a scan transistor which supplies a data voltage of a data line connected thereto to the gate electrode of the driving transistor in response to a scan signal of a scan line connected thereto, and a storage capacitor which holds the voltage at the gate electrode of the driving transistor during a certain period.

In this case, a drain-source current Ids of the driving transistor supplied to the organic light emitting device may be expressed as the following Equation (1):

$$Ids=k'\times(Vgs-Vth)^2 \quad (1)$$

where k' denotes a proportional coefficient determined based on a physical characteristic and a structure of the driving transistor, Vgs denotes a gate-source voltage of the driving transistor, and Vth denotes a threshold voltage of the driving transistor.

A threshold voltage and an electron mobility of the driving transistor for each pixel can be changed due to a cause such as deterioration of the driving transistor caused by long-time driving or a process differential which occurs in manufacturing the organic light emitting display device. That is, in a case of applying the same data voltage to pixels, a current supplied to each of organic light emitting devices should be constant, but due to a threshold voltage difference and an electron mobility difference between driving transistors of the pixels, even when the same data voltage is applied to the pixels, currents supplied to the organic light emitting devices of the pixels can differ.

A driving period of a threshold voltage sensing mode for detecting the threshold voltage of the driving transistor of each of the pixels is longer than a driving period of an electron mobility sensing mode for detecting the electron mobility of the driving transistor of each of the pixels. The threshold voltage sensing mode performed during a relatively long period is performed until the organic light emitting display device is turned off, and the electron mobility sensing mode performed during a relatively short period is performed as soon as the organic light emitting display device is turned on.

Recently, as a resolution of an organic light emitting display device increases, the number of pixels increases. For example, if the resolution of the organic light emitting display device increases from full high definition (FHD) to ultra high definition (UHD), the number of the pixels increase from 1920×1080 to 3840×2160. As the number of the pixels increases, a period in which the electron mobility sensing mode is performed increases, and for this reason, a time taken until the organic light emitting display device displays an image after a user turns on the organic light emitting display device increases.

BRIEF SUMMARY

Accordingly, the present disclosure is directed to provide an organic light emitting display device and a driving method thereof that substantially obviate one or more problems due to limitations and disadvantages of the related art.

An aspect of the present disclosure is directed to provide an organic light emitting display device and a driving method thereof, which decrease a time taken until an image is displayed after a user turns on the organic light emitting display device.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided an organic light emitting display device including a display panel including a plurality of data lines, a plurality of scan lines, and a plurality of pixels respectively provided in a plurality of areas defined by intersections of the plurality of data lines and the plurality of scan lines, a display panel driver configured to apply data voltages to the plurality of data lines and applying scan signals to the plurality of scan lines, and a control circuit board. The control circuit board includes a timing controller configured to control an operation timing of the display panel driver, and a volatile memory. The control circuit board supplies a first main voltage to the volatile memory when the organic light emitting display device is turned off.

In another aspect of the present disclosure, there is provided a driving method of an organic light emitting display device including, performing a first memory read operation in response to a first main voltage being applied when the organic light emitting display device is turned off, the first memory read operation being performed when the organic light emitting display device is subsequently turned on, and including: reading information stored in a volatile memory, and receiving first sensing data from the display panel by driving a display panel according to the information read from the volatile memory.

It is to be understood that both the foregoing general description and the following detailed description of the present disclosure are exemplary and explanatory and are intended to provide further explanation of the disclosure as claimed.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
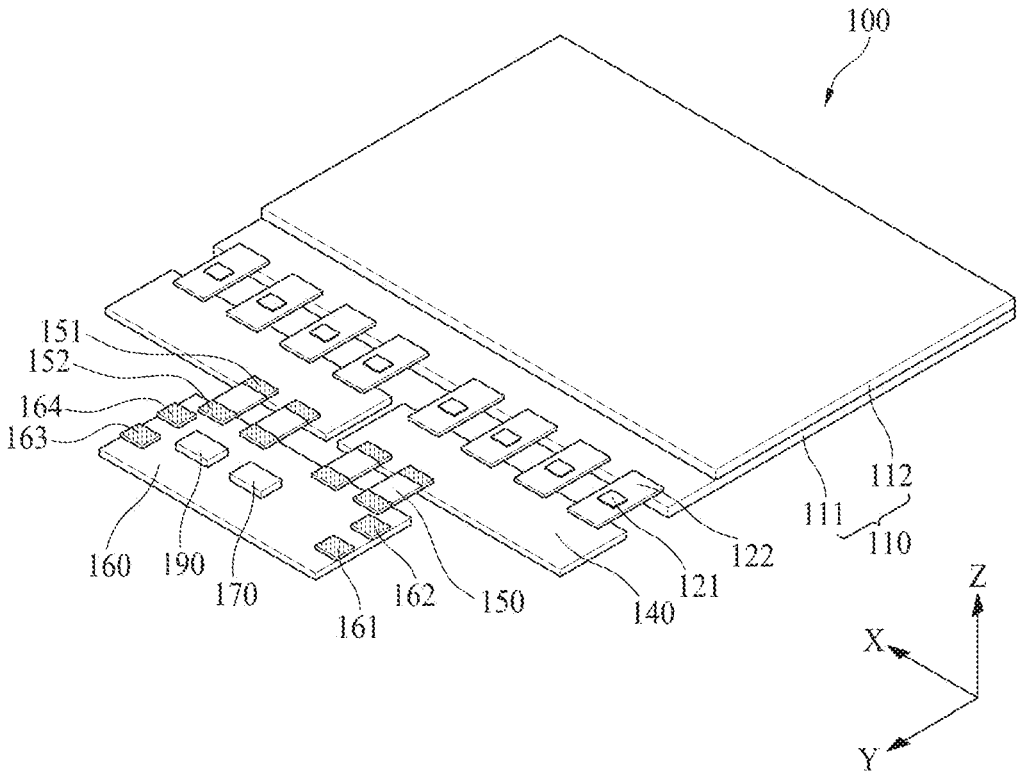
FIG. 1 is a perspective view illustrating an organic light emitting display device according to an embodiment of the present disclosure.

Reference will now be made in detail to the exemplary embodiments of the present disclosure, examples of which are illustrated in the accompanying drawings. Wherever possible, the same reference numbers will be used throughout the drawings to refer to the same or like parts.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise,' 'have,' and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as 'on~,' 'over~,' 'under~,' and 'next~,' one or more other parts may be disposed between the two parts unless 'just' or 'direct' is used.

In describing a time relationship, for example, when the temporal order is described as 'after~,' 'subsequent~,' 'next~,' and 'before~,' a case which is not continuous may be included unless 'just' or 'direct' is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

An X axis direction, a Y axis direction, and a Z axis direction should not be construed as only a geometric relationship where a relationship therebetween is vertical, and may denote having a broader directionality within a scope where elements of the present disclosure operate functionally.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, exemplary embodiments of the present disclosure will be described in detail with reference to the accompanying drawings.

Figure 2:
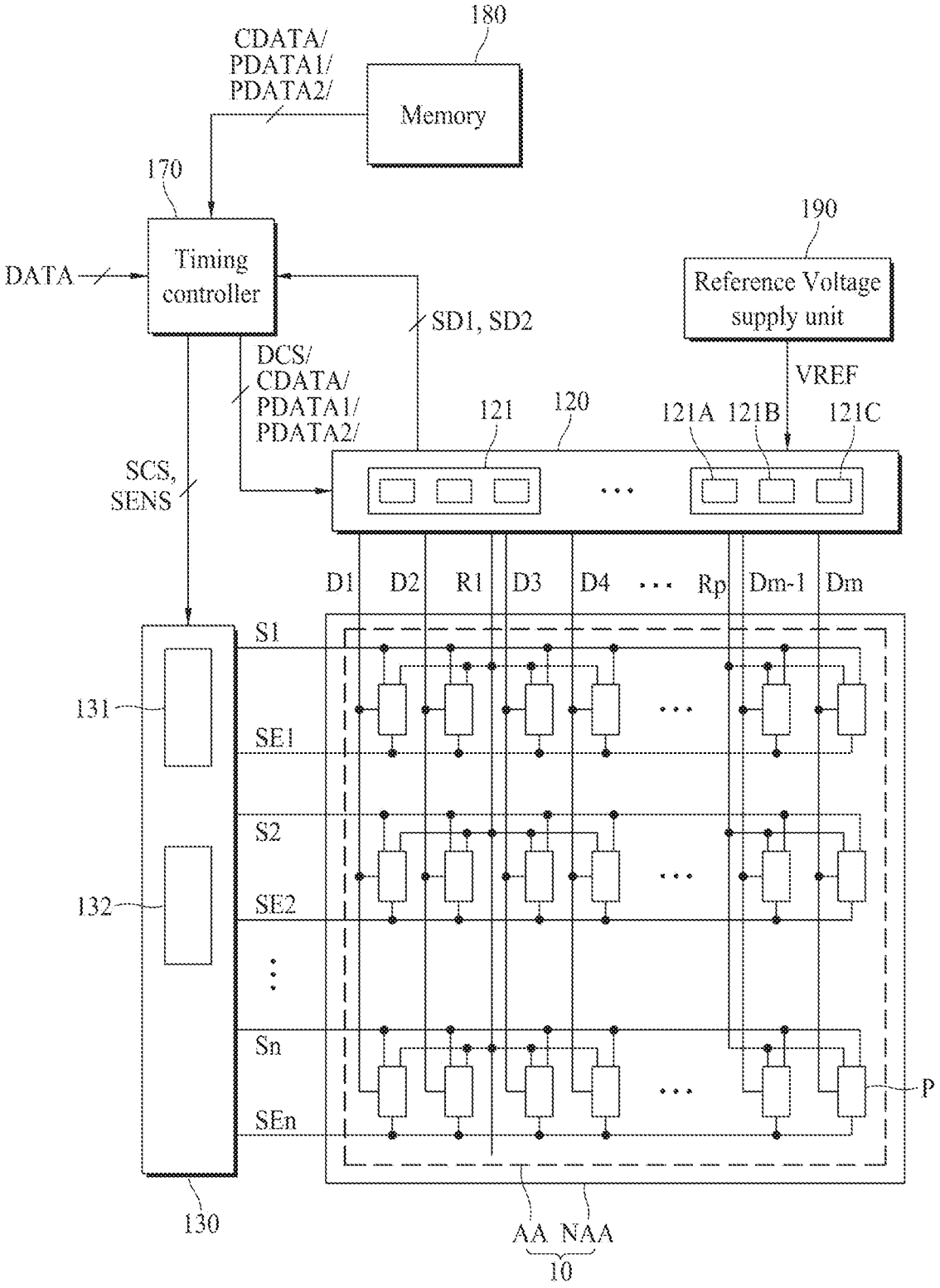
FIG. 2 is a block diagram illustrating an organic light emitting display device according to an embodiment of the present disclosure.

FIG. 1 is a perspective view illustrating an organic light emitting display device according to an embodiment of the present disclosure. FIG. 2 is a block diagram illustrating the organic light emitting display device according to an embodiment of the present disclosure.

Referring to FIGS. 1 and 2, the organic light emitting display device according to an embodiment of the present disclosure may include a display panel 110, a data driver 120, a plurality of flexible films 122, a scan driver 130, a source circuit board 140, a flexible cable 150, a control circuit board 160, a timing controller 170, a memory 180, and a reference voltage supply circuit 190.

The display panel 110 may include a lower substrate 111 and an upper substrate 112. The lower substrate 111 may be formed of glass, plastic, and/or the like, and the upper substrate 112 may be formed of a plastic film, an encapsulation film, a barrier film, or the like.

The display panel 110 may include a display area (or an active area) AA and a non-display area (or an inactive area) NDA provided near the display area AA. The display area AA may be an area where a plurality of pixels P are provided to display an image. A plurality of data lines D1 to Dm (where m is a positive integer equal to or more than two), a plurality of reference voltage lines R1 to Rp (where p is a positive integer equal to or more than two), a plurality of scan lines S1 to Sn (where n is a positive integer equal to or more than two), and a plurality of sensing signal lines SE1 to SEn may be provided in the display panel 110. The data lines D1 to Dm and the reference voltage lines R1 to Rp may intersect the scan lines S1 to Sn and the sensing signal lines SE1 to SEn. As used herein "intersect" does not imply physical or electrical connection between intersecting lines, but instead is used only to mean that the lines that "intersect" are provided in an overlapping manner with one of the lines crossing over another one of the lines, and one or more materials or layers may be disposed between the overlapping lines. The data lines D1 to Dm may be parallel with the reference voltage lines R1 to Rp. The scan lines S1 to Sn may be parallel with the sensing signal lines SE1 to SEn.

Each of the pixels P may be connected to one of the data lines D1 to Dm, one of the reference voltage lines R1 to Rp, one of the scan lines S1 to Sn, and one of the sensing signal lines SE1 to SEn. Each of the pixels P of the display panel 110, as in FIG. 3, may include an organic light emitting device EL and a plurality of transistors for supplying a current to the organic light emitting device EL. Each of the pixels P in the display area AA will be described below in detail with reference to FIG. 3.

The data driver 120 and the scan driver 130 may be referred to as a display panel driver.

The data driver 120, as in FIG. 2, may include a plurality of source drive integrated circuits (ICs) 120. The source drive ICs 121 may be respectively mounted on the flexible films 122. Each of the flexible films 122 may be a tape carrier package or a chip on film. The flexible films 122 may be bent or curved. Each of the flexible films 122 may be attached on the lower substrate 111 and the source circuit board 140. Each of the flexible films 122 may be attached on the lower substrate 111 in a tape automated bonding (TAB) type by using an anisotropic conductive film, and thus, the source drive ICs 121 may be connected to the data lines D1 to Dm.

Each of the source drive ICs 121, as in FIG. 2, may include a data voltage supply unit 121A, an analog-to-digital converter (ADC) 121B, and a switching unit 121C.

The data voltage supply unit 121A may be connected to the data lines to supply data voltages to the data lines. The data voltage supply unit 121A may receive a data timing control signal DCS and one of compensation video data CDATA and first and second sensing video data PDATA1 and PDATA2 from the timing controller 170.

In a display mode, the data voltage supply unit 121A may receive the compensation video data CDATA, convert the compensation video data CDATA into emission data voltages according to the data timing control signal DCS, and supply the emission data voltages to the data lines. The display mode may be a mode where the pixels P emit lights to display an image. Each of the emission data voltages may be a voltage which allows an organic light emitting device EL of a corresponding pixel P to emit light having certain luminance.

In a first sensing mode, the data voltage supply unit 121A may receive first sensing video data PDATA1, convert the first sensing video data PDATA1 into a first sensing data voltage according to the data timing control signal DCS, and supply the first sensing data voltage to the data lines. The first sensing mode may be an electron mobility sensing mode where a source voltage of a driving transistor DT is sensed for compensating for an electron mobility of the driving transistor of each of the pixels P.

In a second sensing mode, the data voltage supply unit 121B may receive second sensing video data PDATA2, convert the second sensing video data PDATA2 into a second sensing data voltage according to the data timing control signal DCS, and supply the second sensing data voltage to the data lines. The second sensing mode may be a threshold voltage compensation mode where the source voltage of the driving transistor DT is sensed for compensating for a threshold voltage of the driving transistor DT of each of the pixels P.

The ADC 121B may convert voltages, sensed from the reference voltage lines in the first and second sensing modes, into digital sensing data SD1/SD2 to the timing controller 170 and may output the digital sensing data SD1/SD2 to a data compensator.

The switching unit 121C may switch a connection between the reference voltage lines and the reference voltage supply circuit 190 and may switch a connection between the reference voltage lines R1 to Rp and the ADC 121B. To this end, as in FIG. 3, the switching unit 121C may include a first switch SW1 connected between each of the reference voltage lines and the reference voltage supply circuit 190 and a second switch SW2 connected between each of the reference voltage lines and the ADC 121B.

The scan driver 130 may include a scan signal output unit 131 and a sensing signal output unit 132. The scan signal output unit 131 may be connected to the scan lines S1 to Sn and may supply the scan signals to the scan lines S1 to Sn. The scan signal output unit 131 may supply the scan signals to the scan lines S1 to Sn according to a scan timing control signal SCS input from the timing controller 170.

The sensing signal output unit 132 may be connected to the sensing signal lines SE1 to SEn and may supply sensing signals to the sensing signal lines SE1 to SEn. The sensing signal output unit 132 may supply sensing signals to the sensing signal lines SE1 to SEn according to a sensing timing control signal SENCS input from the timing controller 170.

The scan signal output unit 131 and the sensing signal output unit 132 may each include a plurality of transistors and may be directly provided in the non-display area NDA of the display panel 110 in a gate driver in panel (GIP) type. Alternatively, each of the scan signal output unit 131 and the sensing signal output unit 132 may be configured as a driving chip type and may be mounted on a flexible film connected to the display panel 110.

The source circuit board 140 may include a plurality of connectors 151 which are to be connected to the flexible cable 150 provided in plurality. The source circuit board 140 may be connected to the flexible cables 150 through the connectors 151. The source circuit board 140 may be a flexible printed circuit board (FPCB) or printed circuit board (PCB).

The control circuit board 160 may include a plurality of connectors 152 which are to be connected to the flexible cables 150. The control circuit board 160 may be connected to the flexible cables 150 through the connectors 152.

In FIG. 1, the source circuit board 140 and the control circuit board 160 are illustrated as being connected to the plurality of flexible cables 150 through the plurality of connectors 151 and 152, but are not limited thereto. In other embodiments, each of the source circuit board 140 and the control circuit board 160 may be connected to one flexible cable 150 through one connector 151 or 152.

Moreover, the control circuit board 160 may include a first connector 161, a second connector 162, a third connector 163, a fourth connector 164, the timing controller 170, the memory 180, and the reference voltage supply circuit 190. The timing controller 170 and the reference voltage supply circuit 190 may each be implemented as an IC.

The control circuit board 160 may be connected to a cable connected to a system board through the first connector 161, the second connector 162, the third connector 163, and the fourth connector 164. A first main voltage and a part of video data DATA are supplied to the control circuit board 160 through the first connector 161. The other part of the video data DATA are supplied to the control circuit board 160 through the second connector 162. A main voltage higher than the first main voltage is supplied to the control circuit board 160 through the third connector 163. A high level voltage, which is higher than the main voltage for emission of lights of the organic light emitting devices of the display panel 110, is supplied to the control circuit board 160 through the fourth connector 164. That is, the control circuit board 160 may receive the first main voltage through a pin(s) remaining in the first connector 161.

The control circuit board 160 may be an FPCB or a PCB. The control circuit board 160 will be described below in detail with reference to FIG. 7.

The timing controller 170 may receive the video data DATA and timing signals through the first connector 161 and the second connector 162. That is, the timing controller 170 may receive a first portion of the video data DATA through the first connector 161, and a second portion of the video data DATA through the second connector 162. The timing signals may include a vertical sync signal, a horizontal sync signal, a data enable signal, and a dot clock.

The timing controller 170 may generate control signals for controlling operation timings of the data voltage supply unit 121A, the scan signal output unit 131, and the sensing signal output unit 132. The control signals may include the data timing control signal DCS for controlling the operation timing of the data voltage supply unit 121A, the scan timing control signal SCS for controlling the operation timing of the scan signal output unit 131, and the sensing timing control signal SENCS for controlling the operation timing of the sensing signal output unit 132.

The timing controller 170 may control the organic light emitting display device in one of the display mode, the first sensing mode, and the second sensing mode. The display mode may be a mode where the pixels P emit lights by supplying emission data voltages based on the compensation video data CDATA to the pixels P.

The first sensing mode may be a mode where first sensing data voltages based on the first sensing video data PDATA1 are supplied to the pixels P and voltages of the pixels P are sensed through the reference voltage lines R1 to Rp. The first sensing mode may be a mode where the source voltage of the driving transistor is sensed for compensating for the electron mobility of the driving transistor of each of the pixels P. The first sensing mode may be performed before an image is displayed as soon as the organic light emitting display device is turned on. If a turn-off time of the organic light emitting display device is shorter than a reference time, the first sensing mode may be omitted. Also, the first sensing mode may be performed for sensing voltages of some pixels during a vertical blank period while the organic light emitting display device is displaying an image.

The second sensing mode may be a mode where second sensing data voltages based on the second sensing video data PDATA2 are supplied to the pixels P and voltages of the pixels P are sensed through the reference voltage lines R1 to Rp. The second sensing mode may be a mode where the source voltage of the driving transistor is sensed for compensating for the threshold voltage of the driving transistor of each of the pixels P. The second sensing mode may be performed before the organic light emitting display device is turned off.

In the display mode, the timing controller 170 may convert the video data DATA by using compensation data COMP stored in the memory 180 to generate the compensation video data CDATA. In the display mode, the timing controller 170 may output the compensation video data CDATA and the data timing control signal DCS to the data voltage supply unit 121A, output the scan timing control signal SCS to the scan signal output unit 131, and output the sensing timing control signal SENCS to the sensing signal output unit 132.

In the first sensing mode, the timing controller 170 may output the first sensing video data PDATA1 stored in the memory 180 and the data timing control signal DCS to the data voltage supply unit 121A, output the scan timing control signal SCS to the scan signal output unit 131, and output the sensing timing control signal SENCS to the sensing signal output unit 132. In the first sensing mode, the timing controller 170 may receive first sensing data SD1 from the ADC 121B, perform an arithmetic operation on the first sensing data SD1 to calculate the compensation data COMP, and store the compensation data COMP in the memory 180. The first sensing data SD1 may be data corresponding to digital data which is generated by the ADC 121B converting the sensed source voltage of the driving transistor according to a first sensing data voltage generated by the data voltage supply unit 121A converting the first sensing video data PDATA1.

In the second sensing mode, the timing controller 170 may output the second sensing video data PDATA2 stored in the memory 180 and the data timing control signal DCS to the data voltage supply unit 121A, output the scan timing control signal SCS to the scan signal output unit 131, and output the sensing timing control signal SENCS to the sensing signal output unit 132. The second sensing video data PDATA2 may be data different from the first sensing video data PDATA1. In the second sensing mode, the timing controller 170 may receive second sensing data SD2 from the ADC 121B, perform an arithmetic operation on the second sensing data SD2 to calculate the compensation data COMP, and store the compensation data COMP in the memory 180. The second sensing data SD2 may be data corresponding to digital data which is generated by the ADC 121B converting the sensed source voltage of the driving transistor according to a second sensing data voltage generated by the data voltage supply unit 121A converting the second sensing video data PDATA2.

Moreover, the timing controller 170 may generate and output a first switch control signal SCS1 for controlling the first switch SW1 of the switching unit 121C of the data driver 120 an a second switch control signal SCS2 for controlling the second switch SW2.

The memory 180 may store the first sensing video data PDATA1, the second sensing video data PDATA2, and the compensation data COMP. The timing controller 170 may read the first sensing video data PDATA1, the second sensing video data PDATA2, and the compensation data COMP from the memory 180, perform an arithmetic operation by the first sensing data SD1 and the second sensing data SD2 to calculate new compensation data COMP, and write the new compensation data COMP in the memory 180.

Figure 7:
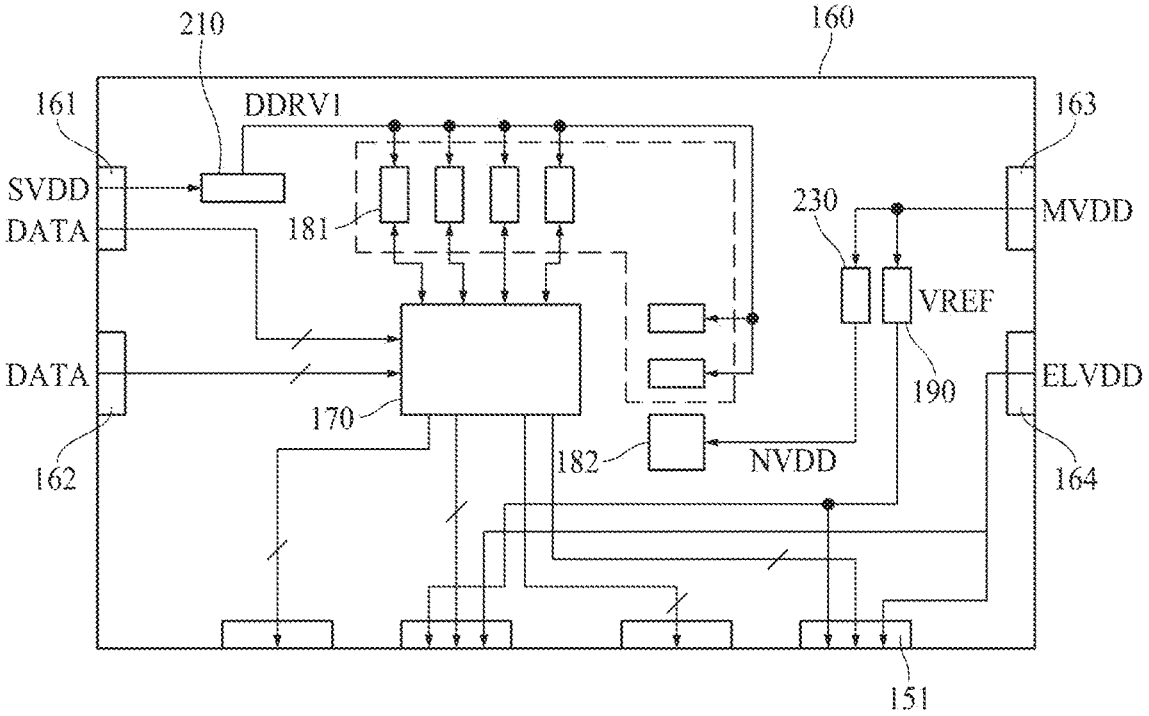
FIG. 7 is an exemplary diagram illustrating in detail a control board of FIG. 1.

The memory 180, as in FIG. 7, may include a plurality of volatile memories 181 and a non-volatile memory 182. For example, each of the volatile memories 181 may be a DDR memory, and the non-volatile memory 182 may be a NAND flash memory. The memory 180 will be described below in detail with reference to FIG. 7.

The reference voltage supply circuit 190 may generate a reference voltage VREF from a main power supplied through the third connector 163 of the control circuit board 160 and may supply the reference voltage VREF to the source drive ICs 121 of the data driver 120.

Figure 3:
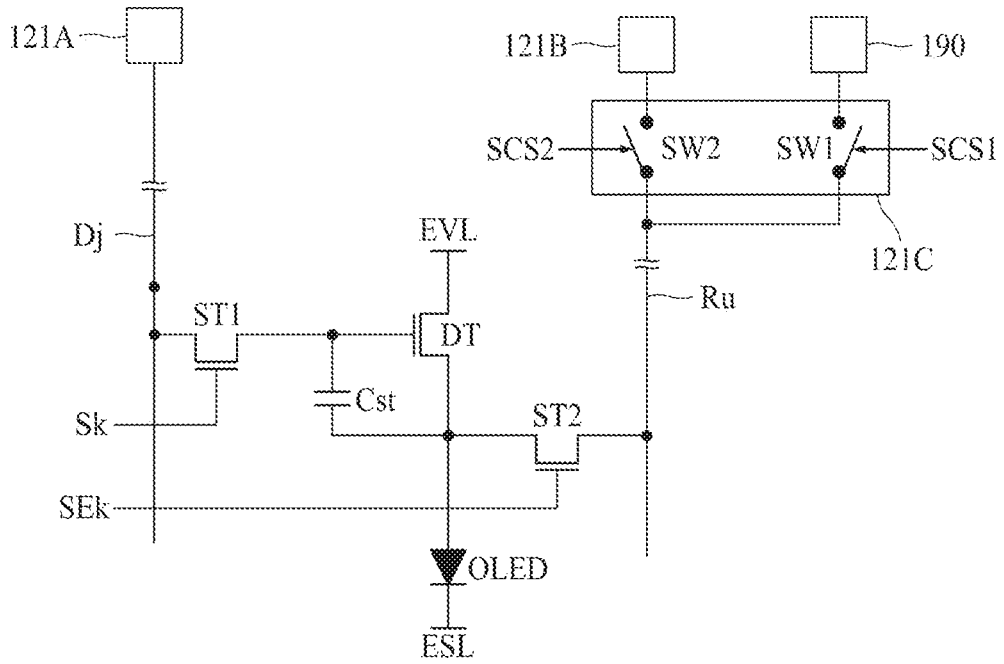
FIG. 3 is a circuit diagram illustrating in detail a pixel of FIG. 2.

FIG. 3 is a circuit diagram illustrating in detail the pixel of FIG. 2.

In FIG. 3, for convenience of description, only a subpixel connected to a jth (where j is a positive integer satisfying $1 \leq j \leq m$) data line Dj, a uth (where u is a positive integer satisfying $1 \leq u \leq p$) reference voltage line Ru, a kth (where k is a positive integer satisfying $1 \leq k \leq n$) scan line Sk, and a kth sensing signal line SEk, the reference voltage supply circuit 190, the data voltage supply unit 121A, the ADC 121B, and the first and second switches SW1 and SW2 of the switching unit 121C are illustrated.

Referring to FIG. 3, the pixel P of the display panel 10 may include an organic light emitting device EL, a driving transistor DT, first and second switching transistors ST1 and ST2, and a storage capacitor Cst.

The organic light emitting device EL may emit light with a current supplied through the driving transistor DT. The organic light emitting device EL may be implemented with an organic light emitting diode. The organic light emitting device EL may include an anode electrode, a hole transporting layer, an organic light emitting layer, an electron transporting layer, and a cathode electrode. In the organic light emitting device EL, when a voltage is applied to the anode electrode and the cathode electrode, a hole and an electron may move to the organic light emitting layer through the hole transporting layer and the electron transporting layer and may be combined with each other to emit light. The anode electrode of the organic light emitting device EL may be connected to a source electrode of the driving transistor DT, and the cathode electrode may be connected to a second power line VSL through which a low level voltage lower than a high level voltage is supplied.

The driving transistor DT may control a current flowing from a first power line EVL to the organic light emitting device EL, based on a voltage difference of a gate electrode and a source electrode thereof. The gate electrode of the driving transistor DT may be connected to a first electrode of the first switching transistor ST1, the source electrode may be connected to the anode electrode of the organic light emitting device EL, and a drain electrode may be connected to the first power line EVL through which the high level voltage is applied.

The first switching transistor ST1 may be turned on by a kth scan signal of the kth scan line Sk and may connect the jth data line Dj to the gate electrode of the driving transistor DT. A gate electrode of the first switching transistor ST1 may be connected to the kth scan line Sk, the first electrode may be connected to the gate electrode of the driving transistor DT, and a second electrode may be connected to the jth data line Dj.

The second switching transistor ST2 may be turned on by a kth sensing signal of the kth sensing signal line SEk and may connect the uth reference voltage line Ru to the source electrode of the driving transistor DT. A gate electrode of the second switching transistor ST2 may be connected to the kth sensing signal line SEk, a first electrode may be connected to the uth reference voltage line Ru, and a second electrode may be connected to the source electrode of the driving transistor DT.

The first electrode of each of the first and second switching transistors ST1 and ST2 may be a source electrode, and the second electrode may be a drain electrode. However, the present embodiment is not limited thereto. In other embodiments, the first electrode of each of the first and second switching transistors ST1 and ST2 may be a drain electrode, and the second electrode may be a source electrode.

The storage capacitor Cst may be provided between the gate electrode and the source electrode of the driving transistor DT. The storage capacitor Cst may store a difference voltage between a gate voltage and a source voltage of the driving transistor DT.

The driving transistor DT and the first and second switching transistors ST1 and ST2 may each be configured as a thin film transistor. Also, an example where the driving transistor DT and the first and second switching transistors ST1 and ST2 are each configured as an N-type metal oxide semiconductor field effect transistor (MOSFET) has been described above with reference to FIG. 3, but the present embodiment is not limited thereto. In other embodiments, the driving transistor DT and the first and second switching transistors ST1 and ST2 may each be configured as a P-type MOSFET. In this case, timing diagrams of FIGS. 4 to 6 may be appropriately corrected based on a characteristic of the P-type MOSFET.

Figure 4:
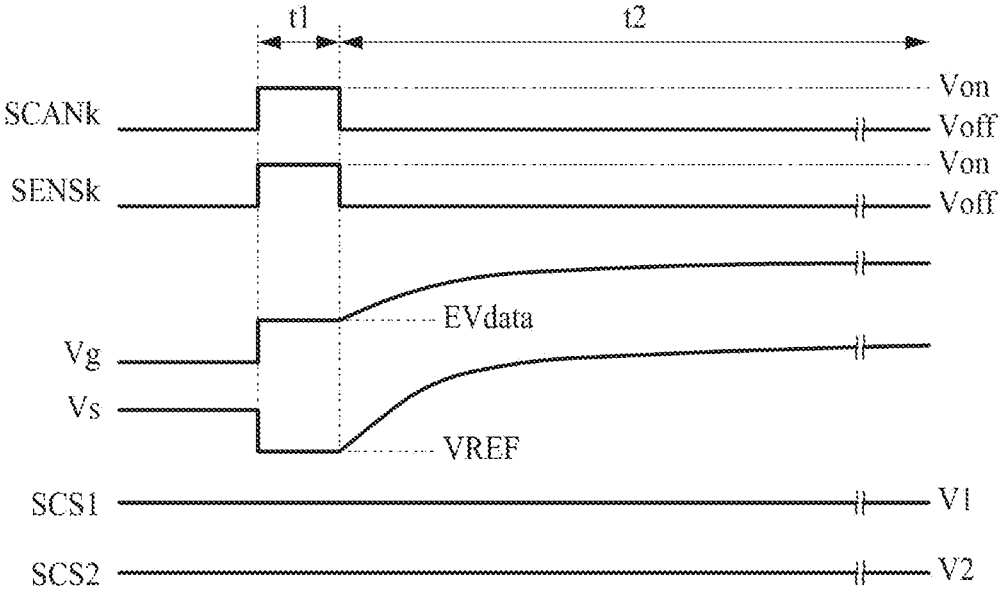
FIG. 4 is a waveform diagram showing a scan signal and a sensing signal supplied to a pixel, first and second switch control signals supplied to first and second switches, and a gate voltage and a source voltage of a driving transistor in a display mode.

FIG. 4 is a waveform diagram showing a scan signal and a sensing signal supplied to a pixel, first and second switch control signals supplied to first and second switches, and a gate voltage and a source voltage of a driving transistor in a display mode.

Referring to FIG. 4, in the display mode, one frame period may include a first period t1 and a second period t2. The period t1 is a period where an emission data voltage EVdata is supplied to the gate electrode of the driving transistor DT and the source electrode is initialized to the reference voltage VREF. The second period t2 is a period where the organic light emitting device EL emits light with a current Ids of the driving transistor DT. The first period t1 may be one horizontal period. The one horizontal period denotes a period where data voltages are supplied to pixels P of one horizontal line.

The kth scan signal SCANk of the kth scan line Sk and the kth sensing signal SENSk of the kth sensing signal line SEk are supplied as a gate-on voltage Von during the first period t1 and are supplied as a gate-off voltage during the second period t2. The first and second switching transistors ST1 and ST2 of the pixel P may be turned on by the gate-on voltage Von and may be turned off by the gate-off voltage Voff.

The first switch control signal SCS1 may be supplied as a first logic level voltage V1 during the first and second periods t1 and t2. The second switch control signal SCS2 may be supplied as a second logic level voltage V2 during the first and second periods t1 and t2. The first and second switches SW1 and SW2 may be turned on by the first logic level voltage and may be turned off by the second logic level voltage. Therefore, during the first and second periods t1 and t2 of the display mode, the first switch SW1 may be turned on by the first switch control signal SCS1 having the first logic level voltage V1, and the second switch SW2 may be turned on by the second switch control signal SCS2 having the second logic level voltage V2. Therefore, in the display mode, the reference voltage supply circuit 190 may supply the reference voltage VREF to the uth reference voltage line Ru.

Hereinafter, an operation of the pixel P during the first and second periods t1 and t2 of the display mode will be described in detail with reference to FIGS. 3 and 4.

First, during the first period t1, the first switching transistor ST1 may be turned on by the kth scan signal SCANk having the gate-on voltage Von supplied through the kth scan line Sk. During the first period t1, the second switching transistor ST2 may be turned on by the kth sensing signal SENSk having the gate-on voltage Von supplied through the kth sensing signal line SEk. During the first period t1, the first switching transistor ST1 may be turned on, and thus, the emission data voltage EVdata of the jth data line Dj may be supplied to the gate electrode of the driving transistor DT. During the first period t1, the second switching transistor ST2 may be turned on, and thus, the reference voltage VREF of the uth reference voltage lien Ru may be supplied to the source electrode of the driving transistor DT.

Second, during the second period t2, the first switching transistor ST1 may be turned off by the kth scan signal SCANk having the gate-off voltage Voff supplied through the kth scan line Sk. During the second period t2, the second switching transistor ST2 may be turned off by the kth sensing signal SENSk having the gate-off voltage Voff supplied through the kth sensing signal line SEk.

During the second period t2, the current Ids based on a voltage difference between a gate voltage Vg and a source voltage Vs of the driving transistor DT may flow to the organic light emitting device EL. Therefore, the organic light emitting device EL may emit light. Hereinafter, for convenience of description, "the current Ids which flows through the driving transistor DT according to a voltage difference between the gate voltage Vg and the source voltage Vs of the driving transistor DT" may be defined as "a current Ids of a driving transistor."

As described above, in an embodiment of the present disclosure, the emission data voltage EVdata may be supplied to the pixel P in the display mode. The emission data voltage EVdata may be a data voltage generated based on the compensation video data CDATA which is generated by compensating for the digital video data DATA after the source voltage of the driving transistor DT is sensed in the sensing mode. As a result, in an embodiment of the present disclosure, the organic light emitting device EL of the pixel P may emit light with the current Ids of the driving transistor DT independent from the threshold voltage of the driving transistor DT. Accordingly, in an embodiment of the present disclosure, a luminance uniformity of the pixels P is enhanced.

Figure 5:
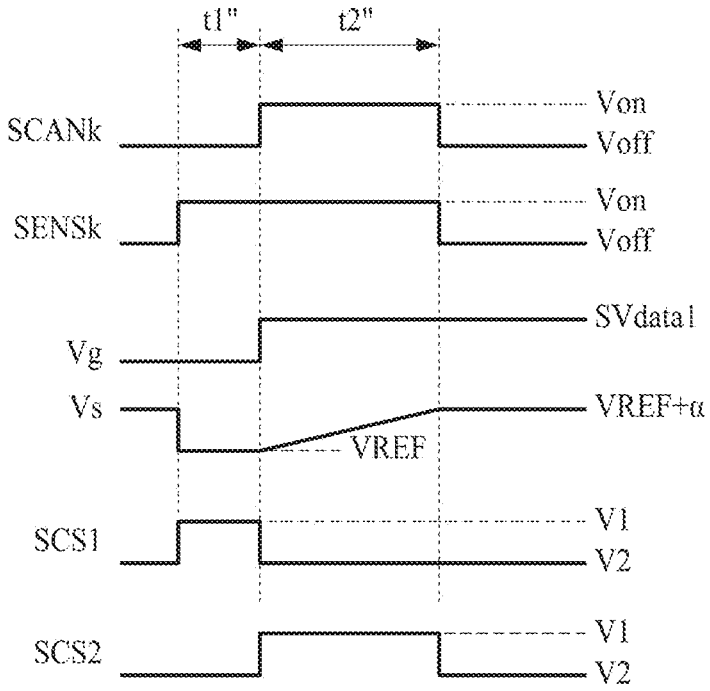
FIG. 5 is a waveform diagram showing a scan signal and a sensing signal supplied to a pixel, first and second switch control signals supplied to first and second switches, and a gate voltage and a source voltage of a driving transistor in a first sensing mode.

FIG. 5 is a waveform diagram showing a scan signal and a sensing signal supplied to a pixel, first and second switch control signals supplied to first and second switches, and a gate voltage and a source voltage of a driving transistor in a first sensing mode.

Referring to FIG. 5, in the first sensing mode, one frame period may include a first period t1" and a second period t2". The period t1" is a period where the source electrode of the driving transistor DT is initialized to the reference voltage VREF. The second period t2" is a period where a first sensing data voltage SVdata1 is applied to the gate electrode of the driving transistor DT and the source voltage of the driving transistor DT is sensed.

The kth scan signal SCANk of the kth scan line Sk is supplied as the gate-on voltage Von during the second period t2". The kth sensing signal SENSk of the kth sensing signal line SEk is supplied as the gate-on voltage Von during the first and second periods t1" and t2".

The first switch control signal SCS1 is supplied as the first logic level voltage V1 during the first period t1", and is supplied as the second logic level voltage V2 during the second period t2". The second switch control signal SCS2 is supplied as the second logic level voltage V2 during the first period t1", and is supplied as the first logic level voltage V1 during the second period t2".

Hereinafter, an operation of the pixel P during the first and second periods t1" and t2" of the first sensing mode will be described in detail with reference to FIGS. 3 and 5.

First, during the first period t1", the first switching transistor ST1 may be turned off by the kth scan signal SCANk having the gate-off voltage Voff supplied through the kth scan line Sk, and the second switching transistor ST2 may be turned on by the kth sensing signal SENSk having the gate-on voltage Von supplied through the kth sensing signal line SEk. During the first period t1", the first switch SW1 may be turned on by the first switch control signal SCS1 having the first logic level voltage V1, and the second switch SW2 may be turned off by the second switch control signal SCS2 having the second logic level voltage V2.

During the first period t1", the first switch SW1 may be turned on, and thus, the reference voltage supply circuit 190 may supply the reference voltage VREF to the uth reference voltage lien Ru. During the first period t1", the second switching transistor ST2 may be turned on, and thus, the reference voltage VREF of the uth reference voltage lien Ru may be supplied to the source electrode of the driving transistor DT. That is, the source electrode of the driving transistor DT may be initialized to the reference voltage VREF.

Second, during the second period t2", the first switching transistor ST1 may be turned on by the kth scan signal SCANk having the gate-on voltage Von supplied through the kth scan line Sk, and the second switching transistor ST2 may be turned on by the kth sensing signal SENSk having the gate-on voltage Von supplied through the kth sensing signal line SEk. During the second period t2", the first switch SW1 may be turned off by the first switch control signal SCS1 having the second logic level voltage V2, and the second switch SW2 may be turned on by the second switch control signal SCS2 having the first logic level voltage V1.

During the second period t2", since the first switch SW1 is turned off, the reference voltage VREF is not supplied to the uth reference voltage line Ru. Also, during the second period t2", since the second switch SW2 is turned on, the uth reference voltage line Ru is connected to the ADC 121B. During the second period t2", since the first switching transistor ST1 is turned on, the first sensing data voltage SVdata1 is supplied to the gate electrode of the driving transistor DT. During the second period t2", since the second switching transistor ST2 is turned on, the source electrode of the driving transistor DT is connected to the ADC 121B through the uth reference voltage line Ru.

During the second period t2", a voltage difference "Vgs=SVdata1−VREF" between the gate electrode and the source electrode of the driving transistor DT is greater than the threshold voltage Vth of the driving transistor DT, a current flows through the driving transistor DT.

In this case, the current of the driving transistor DT may be defined as expressed in the following Equation (2):

$$Ids = \frac{K \times Cox \times W/L}{2} \times (Vgs - Vth)^2 \quad (2)$$

where Ids denotes the current of the driving transistor DT, K denotes electron mobility, Cox denotes a capacitance of an insulation layer, W denotes a channel width of the driving transistor DT, and L denotes a channel length of the driving transistor DT.

The current of the driving transistor DT is proportional to the electron mobility K of the driving transistor DT as in Equation (2), and thus, an increase in source voltage Vs of the driving transistor DT during the second period t2" is proportional to the electron mobility K of the driving transistor DT. That is, as the electron mobility K of the driving transistor DT increases, the source voltage Vs of the driving transistor DT increases more during the second period t2".

As a result, during the second period t2", an increase in source voltage Vs of the driving transistor DT during the second period t2" varies according to the electron mobility K of the driving transistor DT. In FIG. 5, an increase amount of the source voltage Vs based on the electron mobility K is defined as α. The source voltage of the driving transistor DT increases to "VREF+α" as in FIG. 5, based on the electron mobility K. Therefore, during the second period t2", a voltage obtained by reflecting the electron mobility K of the driving transistor DT in the source electrode of the driving transistor DT is sensed.

As described above, in an embodiment of the present disclosure, the source voltage "VREF+α" of the driving transistor in which the electron mobility K of the driving transistor DT is reflected may be sensed in the second sensing mode.

Figure 6:
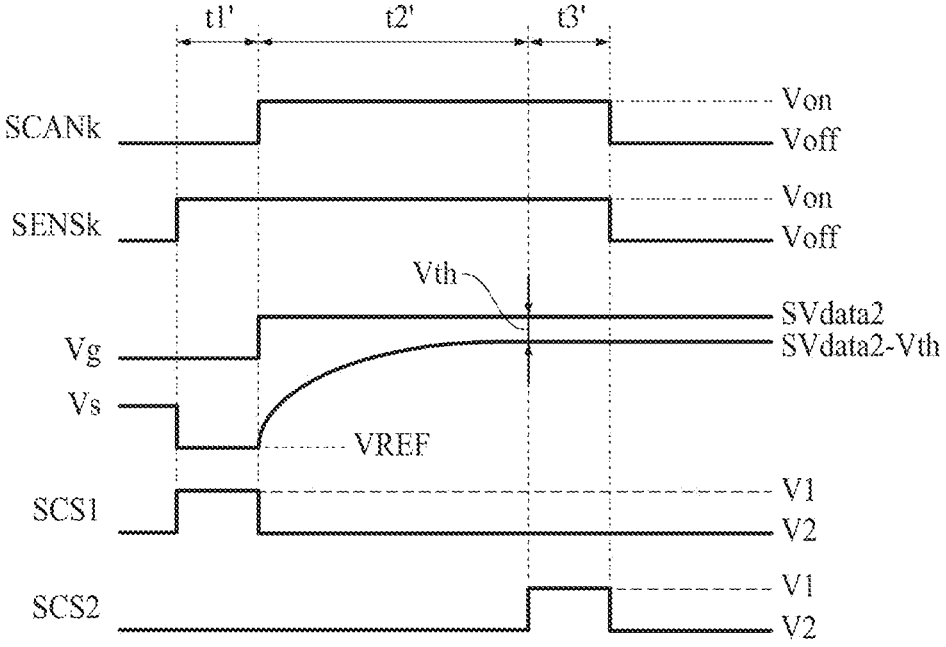
FIG. 6 is a waveform diagram showing a scan signal and a sensing signal supplied to a pixel, first and second switch control signals supplied to first and second switches, and a gate voltage and a source voltage of a driving transistor in a second sensing mode.

FIG. 6 is a waveform diagram showing a scan signal and a sensing signal supplied to a pixel, first and second switch control signals supplied to first and second switches, and a gate voltage and a source voltage of a driving transistor in a second sensing mode.

Referring to FIG. 6, in the second sensing mode, one frame period may include first to third periods t1' to t3'. The period t1' is a period where the source electrode of the driving transistor DT is initialized to the reference voltage VREF. The second period t2' is a period where a second sensing data voltage SVdata2 is supplied to the gate electrode of the driving transistor DT. The third period t3' is a period where the source voltage of the driving transistor DT is sensed.

The kth scan signal SCANk of the kth scan line Sk is supplied as the gate-on voltage Von during the second and third periods t2' and t3'. The kth sensing signal SENSk of the kth sensing signal line SEk is supplied as the gate-on voltage Von during the first to third periods t1' to t3'. The first and second switching transistors ST1 and ST2 of the pixel P may be turned on by the gate-on voltage Von and may be turned off by the gate-off voltage Voff.

The first switch control signal SCS1 is supplied as the first logic level voltage V1 during the first period t1', and is supplied as the second logic level voltage V2 during the second and third periods t2' and t3'. The second switch control signal SCS2 is supplied as the second logic level voltage V2 during the first and second periods t1' and t2', and is supplied as the first logic level voltage V1 during the third period t3'. Each of the first and second switches SW1 and SW2 may be turned on by the first logic level voltage and may be turned off by the second logic level voltage.

Hereinafter, an operation of the pixel P in the second sensing mode will be described in detail with reference to FIGS. 3 and 6.

First, during the first period t1', the first switching transistor ST1 may be turned off by the kth scan signal SCANk having the gate-off voltage Voff supplied through the kth scan line Sk, and the second switching transistor ST2 may be turned on by the kth sensing signal SENSk having the gate-on voltage Von supplied through the kth sensing signal line SEk. During the first period t1', the first switch SW1 may be turned on by the first switch control signal SCS1 having the first logic level voltage V1, and the second switch SW2 may be turned off by the second switch control signal SCS2 having the second logic level voltage V2.

During the first period t1', since the first switch SW1 is turned on, the reference voltage supply circuit 190 may supply the reference voltage VREF to the uth reference voltage lien Ru. During the first period t1', since the second switching transistor ST2 is turned on, the reference voltage VREF of the uth reference voltage lien Ru may be supplied to the source electrode of the driving transistor DT. That is, the source electrode of the driving transistor DT may be initialized to the reference voltage VREF.

Second, during the second period t2', the first switching transistor ST1 may be turned on by the kth scan signal SCANk having the gate-on voltage Von supplied through the kth scan line Sk, and the second switching transistor ST2 may be turned on by the kth sensing signal SENSk having the gate-on voltage Von supplied through the kth sensing signal line SEk. During the second period t2', the first switch SW1 may be turned off by the first switch control signal SCS1 having the second logic level voltage V2, and the second switch SW2 may be turned off by the second switch control signal SCS2 having the second logic level voltage V2.

During the second period t2', since the first switch SW1 is turned off, the reference voltage VREF is not supplied to the uth reference voltage line Ru. Also, during the second period t2', since the first switching transistor ST1 is turned on, the second sensing data voltage SVdata2 is supplied to the gate electrode of the driving transistor DT.

During the second period t2', a voltage difference "Vgs=SVdata2−VREF" between the gate electrode and the source electrode of the driving transistor DT is greater than the threshold voltage Vth of the driving transistor DT, a current flows through the driving transistor DT until the voltage difference Vgs between the gate electrode and the source electrode of the driving transistor DT reaches the threshold voltage Vth. Therefore, as in FIG. 7, the source voltage of the driving transistor DT increases to "SVdata2−Vth." That is, during the second period t2', the threshold voltage of the driving transistor DT is sensed from the source electrode of the driving transistor DT.

Third, during the third period t3', the first switching transistor ST1 may be turned on by the kth scan signal SCANk having the gate-on voltage Von supplied through the kth scan line Sk, and the second switching transistor ST2 may be turned on by the kth sensing signal SENSk having the gate-on voltage Von supplied through the kth sensing signal line SEk. During the third period t3', the first switch SW1 may be turned off by the first switch control signal SCS1 having the second logic level voltage V2, and the second switch SW2 may be turned on by the second switch control signal SCS2 having the first logic level voltage V1.

During the third period t3', since the second switch SW2 is turned on, the uth reference voltage line Ru is connected to the ADC 121B. During the third period t3', since the second switching transistor ST2 is turned on, the source electrode of the driving transistor DT is connected to the ADC 121B through the uth reference voltage line Ru. Accordingly, the ADC 121B may sense the source voltage "SVdata2−Vth" of the driving transistor DT.

As described above, in an embodiment of the present disclosure, the source voltage "SVdata2−Vth" of the driving transistor in which the electron mobility K of the driving transistor DT is reflected may be sensed in the second sensing mode.

FIG. 7 is an exemplary diagram illustrating in detail the control board of FIG. 1.

Referring to FIG. 7, the control board 160 may include a plurality of connectors 151, a first connector 161, a second connector 162, a third connector 163, a fourth connector 164, the timing controller 170, a plurality of volatile memories 181, and a non-volatile memory 182 connected to the flexible cables 150 (see FIG. 2), the reference voltage supply circuit 190, a first driving voltage supply circuit 210, and a second driving voltage supply circuit 230.

Each of the connectors 151 may be connected to the source circuit board 140 through the flexible cable 150 (see FIG. 2). The compensation video data CDATA, the first sensing video data PDATA1, and the second sensing video data PDATA2 of the timing controller 170 may be supplied to the source drive ICs 121 through the connectors 151, the flexible cables 150, the source circuit boards 140, and the flexible films 122. Also, the reference voltage VREF of the reference voltage supply circuit 190 and the high level voltage ELVDD supplied through the fourth connector 164 may be supplied to the display panel 110 through the connectors 151, the flexible cables 150, the source circuit boards 140, and the flexible films 122.

The first connector 161 may be connected to the system board through a first cable. The video data DATA and the first main voltage SVDD from the system board may be supplied to the first connector 161. The first main voltage SVDD may be a voltage which is supplied from the system board despite the organic light emitting display device being turned off if the power plug is connected to the power source. That is, in a case where the power plug is connected to the power source, the first main voltage SVDD may be supplied even when the organic light emitting display device is turned off, in addition to when the organic light emitting display device is turned on.

The second connector 162 may be connected to the system board through a second cable. The video data DATA from the system board may be supplied to the second connector 162.

The system board may transmit the video data DATA to a V-by-one (V×1) interface. In this case, since the system board transmits the video data DATA by using a plurality of predetermined lanes, the system board may divisionally transmit the video data DATA through the first connector 161 and the second connector 162. Therefore, the first main voltage SVDD may be supplied by using a pin(s) which remains in the first connector 161 without being used for the supply of the video data DATA. Accordingly, in an embodiment of the present disclosure, a separate connector and cable are not connected to the system board in supplying the first main voltage SVDD.

The third connector 163 may be connected to the system board through a third cable. A second main voltage MVDD from the system board may be supplied to the third connector 163. The second main voltage MVDD may be a voltage which is supplied from the system board when the organic light emitting display device is turned on, and may be a main voltage which is used to generate a plurality of driving voltages supplied to the elements included in the control circuit board 160. When the organic light emitting display device is turned off, the second main voltage MVDD may not be supplied. The second main voltage MVDD may be a voltage which is higher than the first main voltage SVDD.

The fourth connector 164 may be connected to the system board through a fourth cable. A high level voltage ELVDD from the system board may be supplied to the fourth connector 164. The high level voltage ELVDD may be a voltage which is used to drive the organic light emitting devices EL of the pixels P of the display panel 110. The high level voltage ELVDD may be a voltage which is supplied from the system board when the organic light emitting display device is turned on. When the organic light emitting display device is turned off, the high level voltage ELVDD may not be supplied. The high level voltage ELVDD may be a voltage which is higher than the second main voltage MVDD.

The first driving voltage supply circuit 210 may convert the first main voltage SVDD, supplied through the first connector 161, into a first main driving voltage DDRV1 and may output the first main driving voltage DDRV1 to the volatile memories 181, whereby the first main driving voltage DDRV1 may be applied to the volatile memories 181. The first driving voltage supply circuit 210 may be a step-down converter which lowers and outputs an input voltage. For example, the first driving voltage supply circuit 210 may convert the first main voltage SVDD of 5V into the first main driving voltage DDRV1 of 1.5V and may output the first main driving voltage DDRV1 of 1.5V. In a case where the power plug is connected to the power source, even when the organic light emitting display device is turned off, the first main voltage SVDD may be continuously supplied. Therefore, in a case where the power plug is connected to the power source, the first driving voltage supply circuit 210 may output the first main driving voltage DDRV1 even when the organic light emitting display device is turned off, in addition to when the organic light emitting display device is turned on.

That is, according to an embodiment of the present disclosure, in a case where the power plug is connected to the power source, even when the organic light emitting display device is turned off, the first main voltage SVDD may be supplied from the system board and may be converted into the first main driving voltage DDRV1, and the first main driving voltage DDRV1 may be supplied to the volatile memories 181. As a result, in an embodiment of the present disclosure, despite the organic light emitting display device being turned off, when the power plug is connected to the power source, information stored in each of the volatile memories 181 is maintained as-is.

The second driving voltage supply circuit 230 may convert the second main voltage MVDD, supplied through the third connector 163, into a second main driving voltage NVDD and may output the second main driving voltage NVDD to the non-volatile memory 182. The second driving voltage supply circuit 230 may be a step-down converter which lowers and outputs an input voltage. Only when the second main voltage MVDD is supplied, the second driving voltage supply circuit 230 can output the second main driving voltage NVDD, and thus, when the organic light emitting display device is turned off, the second driving voltage supply circuit 230 does not output the second main driving voltage NVDD.

The reference voltage supply circuit 190 may convert the second main voltage MVDD, supplied through the third connector 163, into the reference voltage VREF and may output the reference voltage VREF to the connectors 151 connected to the flexible cables 150. The reference voltage supply circuit 190 may be a step-down converter which lowers and outputs an input voltage. Only when the second main voltage MVDD is supplied, the reference voltage supply circuit 190 can output the reference voltage VREF, and thus, when the organic light emitting display device is turned off, the reference voltage supply circuit 190 does not output the reference voltage VREF.

Each of the volatile memories 181 may be a DDR memory, but is not limited thereto. The non-volatile memory 182 may be a NAND memory, but is not limited thereto.

The video data DATA are supplied to the timing controller 170 through the first connector 161 and the second connector 162. The timing controller 170 may communicate with the volatile memories 181 and the non-volatile memory 182. The timing controller 170 may output the compensation video data CDATA, the first sensing video data PDATA1, and the second sensing video data PDATA2 to the connectors 151 connected to the flexible cable 150 according to the display mode, the first sensing mode, and the second sensing mode.

Despite the organic light emitting display device being turned off, when the first main voltage SVDD is supplied to the volatile memory 181 because the power plug is connected to the power source, information stored in the volatile memory 181 is maintained as-is without being erased, and thus, the timing controller 170 may not read information from the non-volatile memory 182. On the other hand, when the first main voltage SVDD is not supplied to the volatile memory 181 because the organic light emitting display device is turned off and the power plug is not connected to the power source, information stored in the volatile memory 181 is erased, and thus, the timing controller 170 should read information from the non-volatile memory 182 and store the read information in the volatile memories 181. This is because a speed at which the timing controller 170 reads information from the volatile memory 181 is faster than a speed at which the timing controller 170 reads information from the non-volatile memory 182.

Hereinafter, a driving method of an organic light emitting display device based on a connection or not of a power plug to a power source when the organic light emitting display device is turned off will be described in detail with reference to FIG. 8.

Figure 8:
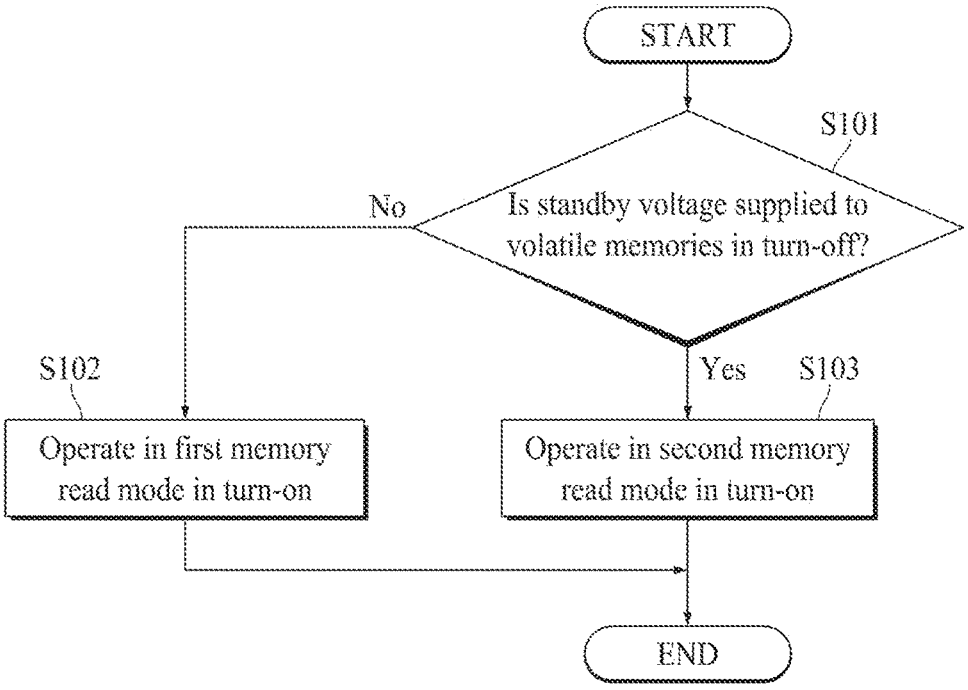
FIG. 8 is a flowchart illustrating a driving method of an organic light emitting display device according to an embodiment of the present disclosure.

FIG. 8 is a flowchart illustrating a driving method of an organic light emitting display device according to an embodiment of the present disclosure.

First, in a case where the power plug is not connected to the power source when the organic light emitting display device is turned off, the first main voltage SVDD is not supplied to the volatile memories 181, and thus, information stored in each of the volatile memories 181 is erased. Therefore, when the organic light emitting display device is turned on, the timing controller 170 may operate in a first memory read mode of reading information stored in the non-volatile memory 182, writing the read information in the volatile memories 181, and again reading the information written in the volatile memories 181 (S101 and S102 of FIG. 8).

Second, in a case where the power plug is connected to the power source when the organic light emitting display device is turned off, the first main voltage SVDD is supplied to the volatile memories 181, and thus, information stored in each of the volatile memories 181 is maintained as-is without being erased. Therefore, when the organic light emitting display device is turned on, the timing controller 170 may operate in a second memory read mode of reading information stored in the volatile memories 181 without reading the information stored in the non-volatile memory 182 (S101 and S103 of FIG. 8).

Hereinafter, an operation of the first memory read mode of the timing controller 170 will be described in detail with reference to FIG. 9, and an operation of the second memory read mode of the timing controller 170 will be described in detail with reference to FIG. 10.

Figure 9:
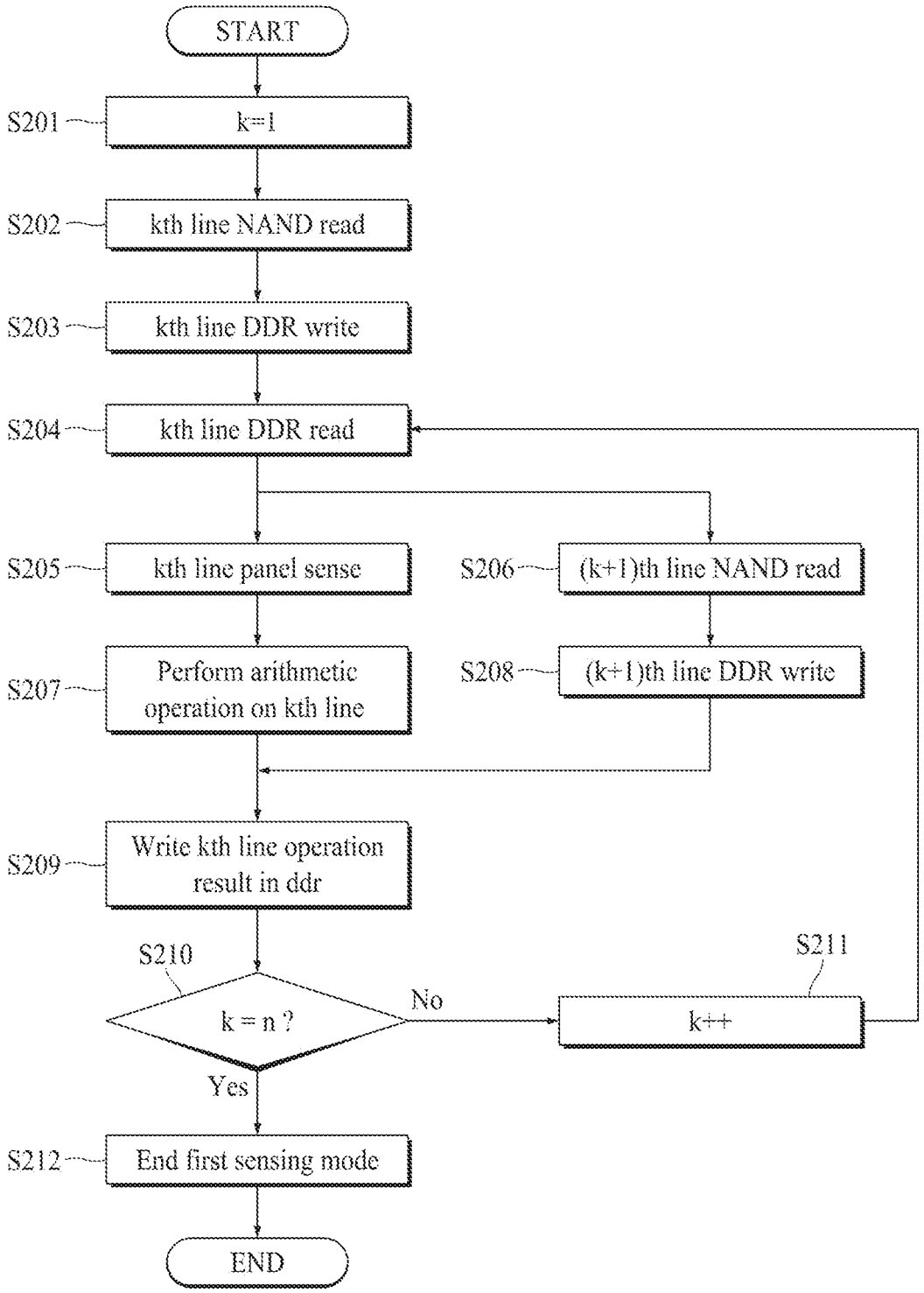
FIG. 9 is a flowchart illustrating a driving method of an organic light emitting display device when a first main voltage is not supplied.

FIG. 9 is a flowchart illustrating a driving method of operating, by an organic light emitting display device, in the first sensing mode as soon as the organic light emitting display device is turned on when the first main voltage is not supplied. FIG. 9 corresponds to a detailed flowchart of step S102 of FIG. 8.

First, since information stored in each of the volatile memories 181 is erased when the first main voltage is not supplied, the timing controller 170 may read information (i.e., the first sensing video data PDATA1 which is to be supplied to each of pixels P of a kth row line of the display panel 110), associated with each of the pixels P of the kth row line, from the non-volatile memory 182. The timing controller 170 may set k to 1. In FIG. 9, an example where the non-volatile memory 182 is a NAND flash memory (NAND) is described (S201 and S202 of FIG. 9).

Second, the timing controller 170 may write the first sensing video data PDATA1, which is to be supplied to each of the pixels P of the kth row line and has been read from the non-volatile memory 182, in the volatile memory(s) 181. In FIG. 9, an example where each of the volatile memories 181 is a DDR memory (DDR) is described (S203 of FIG. 9).

Third, the timing controller 170 may again read the first sensing video data PDATA1 which is to be supplied to each of the pixels P of the kth row line and has been written in the volatile memory(s) 181 (S204 of FIG. 9).

Fourth, the timing controller 170 may output the first sensing video data PDATA1, which is to be supplied to each of the pixels P of the kth row line and has been read from the volatile memory(s) 181, to the data driver 120, and the data driver 120 may convert the first sensing video data PDATA1 into the first sensing data voltages SVdata1 to output the first sensing data voltages SVdata1. Each of the pixels P of the kth row line may operate as described above with reference to FIG. 5, and thus, the timing controller 170 may receive the first sensing data SD1 from the ADC 121B.

Simultaneously, the timing controller 170 may read information (i.e., the first sensing video data PDATA1 which is to be supplied to each of pixels P of a k+1st row line of the display panel 110), associated with each of the pixels P of the k+1st row line, from the non-volatile memory 182 (S205 and S206 of FIG. 9).

Fifth, the timing controller 170 may perform an arithmetic operation by using the first sensing data SD1 to calculate the first compensation data COMP1 corresponding to electron mobility compensation data. Simultaneously, the timing controller 170 may write the first sensing video data PDATA1, which is to be supplied to each of the pixels P of the k+1st row line and has been read from the non-volatile memory 182, in the volatile memory(s) 181 (S207 and S208 of FIG. 9).

Sixth, the timing controller 170 may write the first compensation data COMP1 in the volatile memory(s) 181 (S209 of FIG. 9).

Seventh, when the kth row line does not correspond to an nth row line, the timing controller 170 may increase k by 1, and then, may repeat steps S204 to S209. When the kth row line corresponds to the nth row line, since the timing controller 170 calculates the first compensation data COMP1 for all of the pixels P and stores the first compensation data COMP1 in the volatile memory(s) 181, the first sensing mode may end, and image display may be performed (S210, S211, and S212 of FIG. 9).

Figure 10:
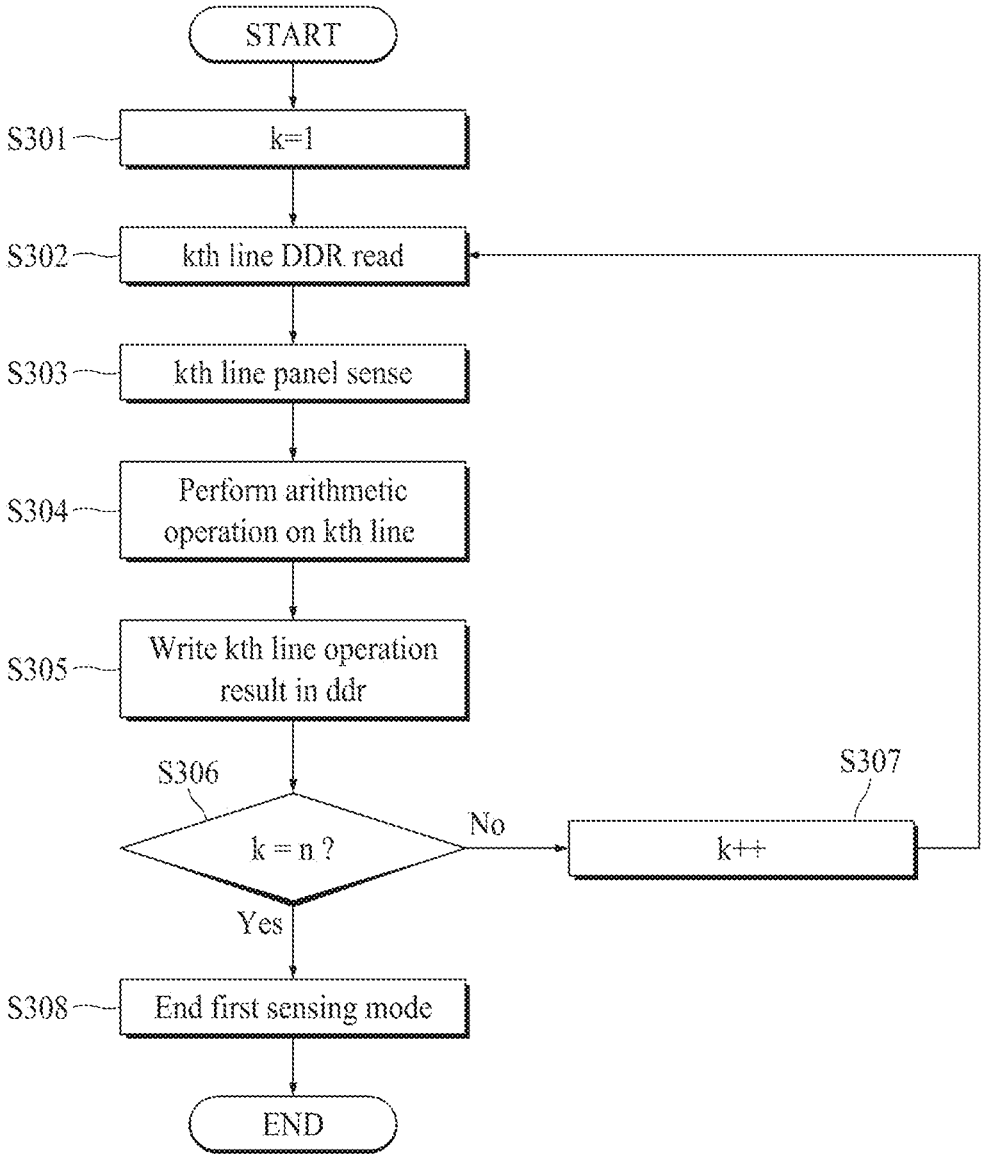
FIG. 10 is a flowchart illustrating a driving method of an organic light emitting display device when a first main voltage is supplied.

FIG. 10 is a flowchart illustrating a driving method of operating, by an organic light emitting display device, in the first sensing mode as soon as the organic light emitting display device is turned on when the first main voltage is supplied. FIG. 10 corresponds to a detailed flowchart of step S103 of FIG. 8.

First, since information stored in each of the volatile memories 181 is maintained as-is without being erased when the first main voltage is supplied, the timing controller 170 may read information (i.e., the first sensing video data PDATA1 which is to be supplied to each of the pixels P of the kth row line of the display panel 110), associated with each of the pixels P of the kth row line, from the non-volatile memory 182. The timing controller 170 may set k to 1. In FIG. 10, an example where each of the volatile memories 181 is a DDR memory (DDR) is described (S301 and S302 of FIG. 9).

Second, the timing controller 170 may output the first sensing video data PDATA1, which is to be supplied to each of the pixels P of the kth row line and has been read from the volatile memory(s) 181, to the data driver 120, and the data driver 120 may convert the first sensing video data PDATA1 into the first sensing data voltages SVdata1 to output the first sensing data voltages SVdata1. Each of the pixels P of the kth row line may operate as described above with reference to FIG. 5, and thus, the timing controller 170 may receive the first sensing data SD1 from the ADC 121B (S303 of FIG. 10).

Third, the timing controller 170 may perform an arithmetic operation by using the first sensing data SD1 to calculate the first compensation data COMP1 corresponding to the electron mobility compensation data (S304 of FIG. 10).

Fourth, the timing controller 170 may write the first compensation data COMP1 in the volatile memory(s) 181 to cause update (S305 of FIG. 10).

Fifth, when the kth row line does not correspond to the nth row line, the timing controller 170 may increase k by 1, and then, may repeat steps S302 to S305. When the kth row line corresponds to the nth row line, since the timing controller 170 calculates the first compensation data COMP1 for all of the pixels P and stores the first compensation data COMP1 in the volatile memory(s) 181, the first sensing mode may end, and image display may be performed (S306, S307, and S308 of FIG. 9).

That is, in an embodiment of the present disclosure, in a case where the first main voltage is supplied, since the first sensing video data PDATA1 which is to be supplied to each of the pixels P of the kth row line is stored in the volatile memories 181 as-is without being erased when performing the first sensing mode before an image is displayed as soon as the organic light emitting display device is turned on, the first sensing video data PDATA1 which is to be supplied to each of the pixels P of the kth row line may not be read from the non-volatile memory 182. Therefore, in an embodiment of the present disclosure, unlike a case where the first main voltage is not supplied, operations (S202 and S206) of reading information from the non-volatile memory 182 and operations (S203 and S208) of writing information, read from the non-volatile memory 182, in the volatile memory (s) 181 may be omitted in a case where the first main voltage is supplied, thereby considerably reducing a time taken in the first sensing mode. Particularly, a speed at which the timing controller 170 reads information from the volatile memory 181 is far faster than a speed at which the timing controller 170 reads information from the non-volatile memory 182, and thus, in a case where the timing controller 170 needs not read the information from the non-volatile memory 182, a time taken in the first sensing mode is considerably shortened.

Moreover, in an embodiment of the present disclosure, despite the organic light emitting display device being turned off, when the power plug is connected to the power source, the organic light emitting display device may receive the first main voltage SVDD from the system board, and thus, despite the organic light emitting display device being turned off, when the power plug is connected to the power source, information stored in the volatile memory 181 is maintained as-is. Therefore, in an embodiment of the present disclosure, in a case where the first main voltage SVDD is supplied, it is not required to read information stored in the non-volatile memory 182 when turning on the organic light emitting display device. As a result, in an embodiment of the present disclosure, a time taken in the first sensing mode for compensating for the electron mobility of the driving transistor DT of each of the pixels P of the display panel 110 before an image is displayed as soon as the organic light emitting display device is turned on is shortened, and thus, a time taken until an image is displayed after a user turns on the organic light emitting display device is shortened.

As described above, according to the embodiments of the present disclosure, despite the display device being turned off, when the power plug is connected to the power source, the display device may receive the first main voltage from the system board, and thus, despite the display device being turned off, when the power plug is connected to the power source, information stored in the volatile memory is maintained as-is. Therefore, according to the embodiments of the present disclosure, in a case where the first main voltage is supplied, it is not required to read information stored in the non-volatile memory when turning on the display device. As a result, according to the embodiments of the present disclosure, a time taken in the first sensing mode for compensating for the electron mobility of the driving transistor of each of the pixels of the display panel before an image is displayed as soon as the display device is turned on is shortened, and thus, a time taken until an image is displayed after a user turns on the display device is shortened.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An organic light emitting display device, comprising:

a display panel including a plurality of data lines, a plurality of scan lines, and a plurality of pixels respectively provided in a plurality of areas defined by intersections of the plurality of data lines and the plurality of scan lines;

a display panel driver configured to apply data voltages to the plurality of data lines and apply scan signals to the plurality of scan lines; and a control circuit board including:

a timing controller configured to control an operation timing of the display panel driver;

a non-volatile memory; and a volatile memory, wherein, when the organic light emitting display device is turned off, the control circuit board supplies a first main driving voltage that is based on a first main voltage to the volatile memory, and when the organic light emitting display device is turned on, the control circuit board supplies a second main driving voltage that is based on a second main voltage to the non-volatile memory, the second main voltage being different from the first main voltage.

2. The organic light emitting display device of claim 1, wherein the control circuit board is configured to receive the first main voltage when the organic light emitting display device is turned off.

3. The organic light emitting display device of claim 1, wherein the control circuit board further includes a first driving voltage supply circuit that converts the first main voltage into the first main driving voltage and outputs the first main driving voltage to the volatile memory.

4. The organic light emitting display device of claim 3, wherein the control circuit board further includes:

a first connector that receives the first main voltage and a first portion of video data; and a second connector that receives a second portion of the video data, and wherein the first and second portions of the video data received by the first connector and the second connector, respectively, are supplied to the timing controller.

5. The organic light emitting display device of claim 4, wherein the control circuit board further includes:

a third connector that receives the second main voltage; and a second driving voltage supply circuit that converts the second main voltage received from the third connector into the second main driving voltage and outputs the second main driving voltage to the non-volatile memory.

6. The organic light emitting display device of claim 5, wherein the control circuit board further includes a fourth connector that receives a high level voltage which is higher than the second main voltage.

7. The organic light emitting display device of claim 1, wherein the second main voltage is higher than the first main voltage.

8. The organic light emitting display device of claim 1, wherein if the first main voltage is not received by the control circuit board when the organic light emitting display device is turned off, when the organic light emitting display device is subsequently turned on, the timing controller reads information stored in the non-volatile memory, writes the information read from the non-volatile memory to the volatile memory, and reads the information written in the volatile memory.

9. The organic light emitting display device of claim 8, wherein the timing controller receives first sensing data from the display panel by driving the display panel according to the information read from the volatile memory, calculates compensation data by performing an arithmetic operation using the first sensing data, and writes the compensation data to the volatile memory.

10. The organic light emitting display device of claim 1, wherein if the first main voltage is received by the control circuit board when the organic light emitting display device is turned off, when the organic light emitting display device is subsequently turned on, the timing controller receives first sensing data from the display panel by driving the display panel according to information read from the volatile memory, calculates compensation data by performing an arithmetic operation using the first sensing data, and writes the compensation data to the volatile memory.

11. A driving method of an organic light emitting display device, the driving method comprising:

performing a first memory read operation in response to a first main voltage being applied when the organic light emitting display device is turned off, the first memory read operation being performed when the organic light emitting display device is subsequently turned on, and including:

reading information stored in a volatile memory; and receiving first sensing data from a display panel by driving the display panel according to the information read from the volatile memory; and supplying a first main driving voltage to the volatile memory when the organic light emitting display device is turned off, the first main driving voltage being based on the first main voltage; and supplying a second main driving voltage to a non-volatile memory of the organic light emitting display device when the organic light emitting display device is turned on, the second main driving voltage being based on a second main voltage that is different from the first main voltage.

12. The driving method of claim 11, wherein performing the first memory read operation further includes:

calculating compensation data by performing an arithmetic operation using the first sensing data; and writing the compensation data to the volatile memory.

13. The driving method of claim 11, further comprising:

performing a second memory read operation in response to the first main voltage not being applied when the organic light emitting display device is turned off, the second memory read operation being performed when the organic light emitting display device is subsequently turned on, and including:

reading information stored in the non-volatile memory;

writing the information read from the non-volatile memory to the volatile memory; and reading the information written to the volatile memory.

14. The driving method of claim 13, wherein performing the second memory read operation further includes:

receiving the first sensing data from the display panel by driving the display panel according to the information read from the volatile memory;

calculating the compensation data by performing an arithmetic operation using the first sensing data; and writing the compensation data to the volatile memory.

* * * * *